US008813297B2

(12) United States Patent
Rosenzweig et al.

(10) Patent No.: US 8,813,297 B2
(45) Date of Patent: Aug. 26, 2014

(54) FLOOR CLEANING DEVICE

(75) Inventors: Mark Rosenzweig, Chestnut Hill, MA (US); Stephen Gatchell, Cordova, TN (US)

(73) Assignee: Euro-Pro Operating LLC, Newton, MA (US)

( * ) Notice: Subject to any disclaimer, the term of this patent is extended or adjusted under 35 U.S.C. 154(b) by 918 days.

(21) Appl. No.: 12/722,973

(22) Filed: Mar. 12, 2010

(65) Prior Publication Data

US 2011/0219557 A1 Sep. 15, 2011

(51) Int. Cl.
*A46B 5/02* (2006.01)

(52) U.S. Cl.
USPC ..... 15/144.1; 15/414; 15/361; 15/410

(58) Field of Classification Search
USPC ..... 15/361, 410–412, 414, 144.1
See application file for complete search history.

(56) References Cited

U.S. PATENT DOCUMENTS

| | | | | |
|---|---|---|---|---|
| 5,044,674 | A | 9/1991 | Hendrickson | |
| 5,290,074 | A | 3/1994 | Chapman | |
| 5,927,758 | A | 7/1999 | Carlsson | |
| 6,263,821 | B1 | 7/2001 | Hodder | |
| 6,345,408 | B1 | 2/2002 | Nagai et al. | |
| 6,553,613 | B2 | 4/2003 | Onishi et al. | |
| 6,695,352 | B2 * | 2/2004 | Park et al. | 285/7 |
| 6,742,220 | B2 | 6/2004 | Nagai et al. | |
| 6,904,640 | B2 | 6/2005 | Jin et al. | |
| 7,162,769 | B2 | 1/2007 | Tratter | |
| 7,281,298 | B2 | 10/2007 | Joung et al. | |
| 7,383,609 | B2 | 6/2008 | Ji | |
| 7,496,984 | B2 | 3/2009 | Pang | |
| 7,640,617 | B2 | 1/2010 | Kennedy et al. | |
| 7,811,022 | B2 * | 10/2010 | Bobrosky et al. | 401/270 |
| 2002/0078519 | A1 | 6/2002 | Boothby | |
| 2004/0211029 | A1 | 10/2004 | Ueda | |
| 2005/0081326 | A1 | 4/2005 | Jeon | |
| 2005/0115017 | A1 * | 6/2005 | Kim | 15/414 |
| 2005/0115018 | A1 | 6/2005 | Jeon | |
| 2005/0125945 | A1 | 6/2005 | Park | |
| 2006/0156510 | A1 | 7/2006 | Park et al. | |
| 2008/0022483 | A1 | 1/2008 | Potoroka | |
| 2009/0000051 | A1 * | 1/2009 | Rosenzweig et al. | 15/228 |
| 2009/0183329 | A1 | 7/2009 | Kennedy et al. | |
| 2009/0265872 | A1 | 10/2009 | Eldessouky | |
| 2009/0320231 | A1 * | 12/2009 | Rosenzweig et al. | 15/339 |
| 2010/0229336 | A1 | 9/2010 | Conrad | |
| 2012/0272472 | A1 | 11/2012 | Conrad | |

FOREIGN PATENT DOCUMENTS

| | | | |
|---|---|---|---|
| CA | 2678220 | A1 | 9/2010 |
| KR | 10-2009-0079485 | A | 7/2009 |

OTHER PUBLICATIONS

International Search Report and Written Opinion for PCT/US2011/027234 mailed Nov. 24, 2011.
International Preliminary Report on Patentability for PCT/US2011/027234 mailed Sep. 27, 2012.

* cited by examiner

*Primary Examiner* — Joseph J Hail
*Assistant Examiner* — Henry Hong
(74) *Attorney, Agent, or Firm* — Wolf, Greenfield & Sacks, P.C.

(57) ABSTRACT

A floor cleaning device includes a floor cleaning head and a pole directly or indirectly connectable to the floor cleaning head. The pole includes two sections, and a joint for lockably positioning the two pole sections in at least two different angular orientations.

7 Claims, 4 Drawing Sheets

FLOOR CLEANING DEVICE

FIELD

The invention relates to a floor cleaning device and, more particularly, to a floor cleaning device with a pole having two or more angular orientations.

BACKGROUND

Floor cleaning devices typically include a pole that extends, directly or indirectly, from a cleaning head. To access low, hard-to-reach areas with a straight pole, a user may have to bend or crouch. To avoid or limit the need to change a user's posture, foldable pole sections have been proposed. For example, a joint may be provided that locks adjacent sections of a pole in a substantially straight orientation. When the joint is unlocked, the pole sections can freely pivot back and forth as the user moves the cleaning head into and out of low slung spaces. The pole sections may again be straightened, and the joint locked, for cleaning unobstructed areas.

SUMMARY

In one aspect of the invention, a floor cleaning device includes a floor cleaning head and a pole that is connectable, directly or indirectly, to the floor cleaning head. The pole includes two sections that are separated by a joint, the joint being arranged to move the two pole sections between at least two different angular orientations. The joint includes a locking element that is biased into a locking position in each of two different angular positions that correspond to the two different angular orientations of the pole sections. An opposed disengagement member is selectively actuable against the locking element to move the locking element into an unlocked position, allowing adjustment of the joint between the two different angular positions.

In another aspect of the invention, a floor cleaning device includes a floor cleaning head and a pole that is connectable, directly or indirectly, to the floor cleaning head. The pole includes two sections that are separated by a joint. The joint is rotatable between two different angular positions corresponding to two different angular orientations of the pole sections. The joint includes an inner curved sidewall, an adjacent outer curved sidewall, and a pivot. A locking element is slidably mounted about the pivot and is reciprocatingly moveable through the inner and outer curved sidewalls at each of the two different angular positions to lock or unlock the joint.

In another aspect of the invention, a floor cleaning device includes a floor cleaning head and a pole connectable, directly or indirectly, to the floor cleaning head. The pole includes two sections and a rotatable joint to move the two pole sections between two different angular orientations. The joint includes an internal locking system for locking the joint at either of two different angular positions corresponding, respectively, with the two different angular orientations of the pole sections. An actuator is controllable by a user at a handle portion of the pole to selectively disengage the internal locking system, allowing adjustment of the rotatable joint between the two different angular positions.

In a still further aspect of the invention, a floor cleaning device includes a floor cleaning head and a component housing including at least one active functional component. A pole is connectable to the component housing to actuate or interface with the at least one functional component. The pole includes two sections. A cylindrical joint is adapted to move the two pole sections between two different angular orientations, the joint automatically locking in each of the two different angular orientations. An actuator is controllable by a user at a handle portion of the pole to selectively unlock the joint, permitting movement of the pole sections between the two different angular orientations.

BRIEF DESCRIPTION OF DRAWINGS

Other aspects, advantages and novel features will become more apparent from the following detailed description of embodiments of the invention when considered in conjunction with the accompanying drawings wherein.

DETAILED DESCRIPTION OF EMBODIMENTS

Figure 1:
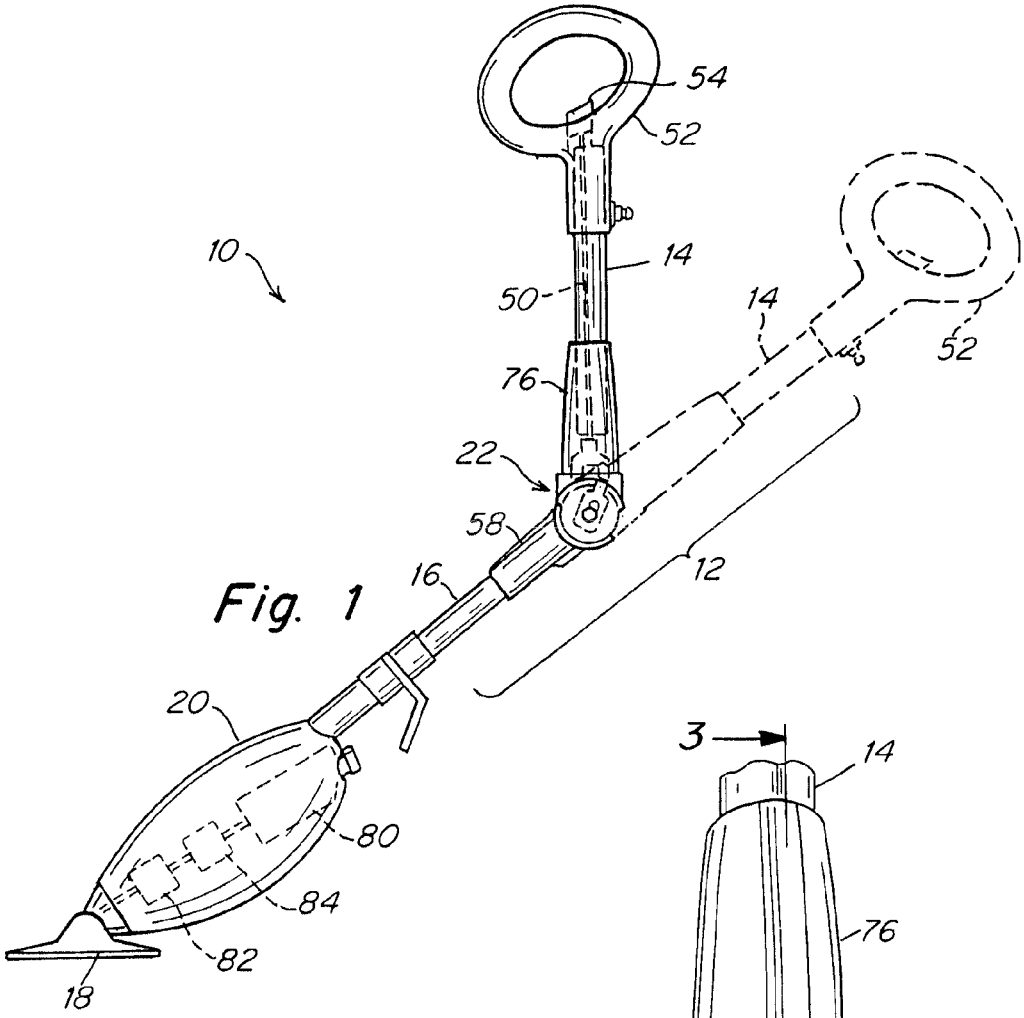
FIG. 1 is an illustration of a steam mop including a pole sections in a first straightened position (partly in phantom) and a second folded position.
Figure 2:
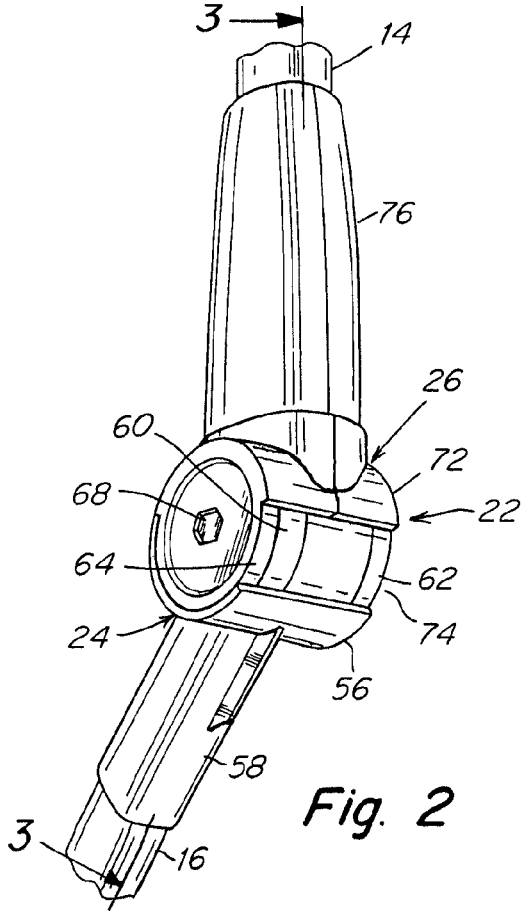
FIG. 2 is an illustration of a joint according to the invention.
Figure 3:
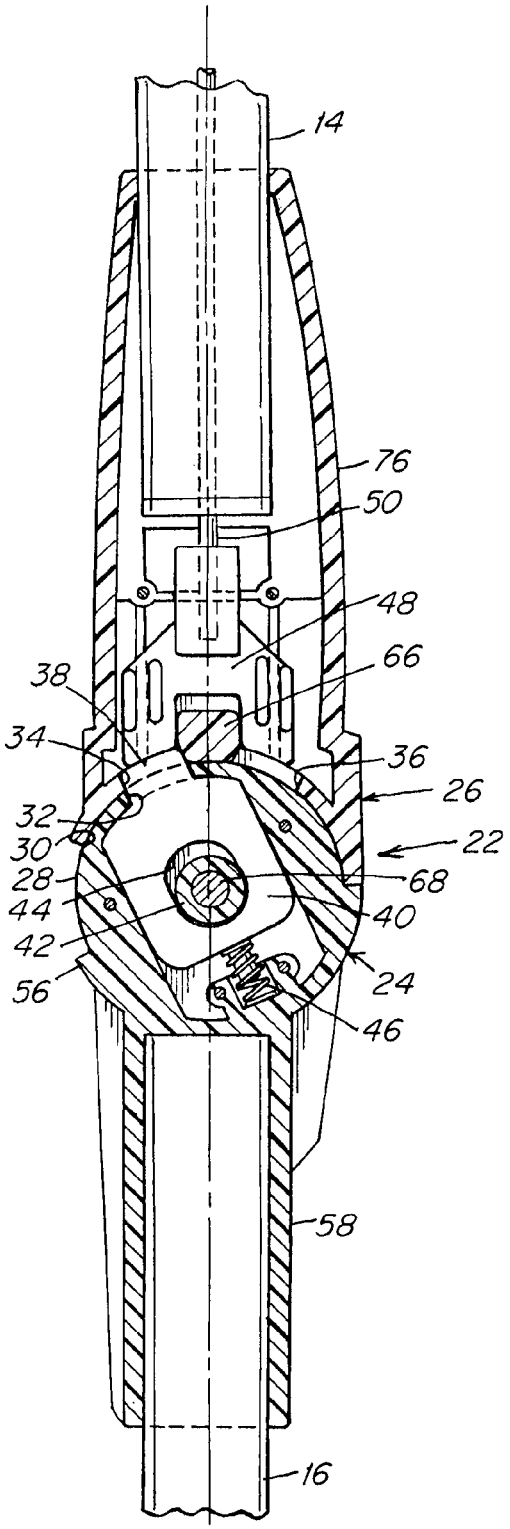
FIGS. 3-5 are sectional illustrations showing rotation of a joint according to the invention between a first and second angular position.
Figure 4:
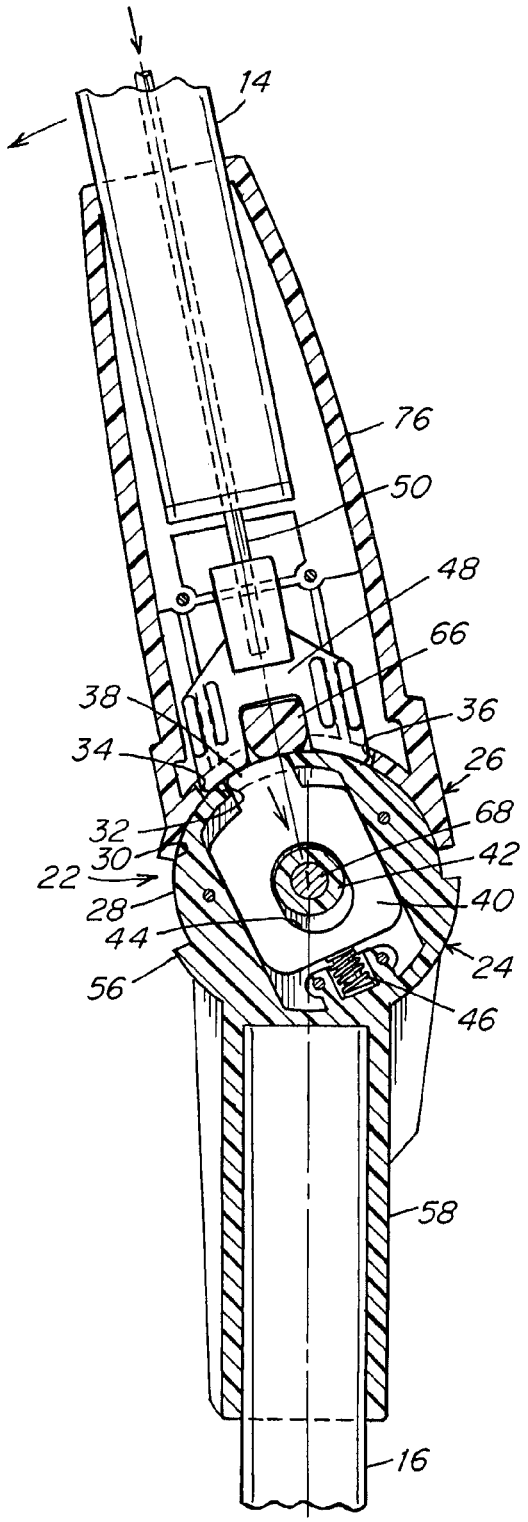
Figure 5:
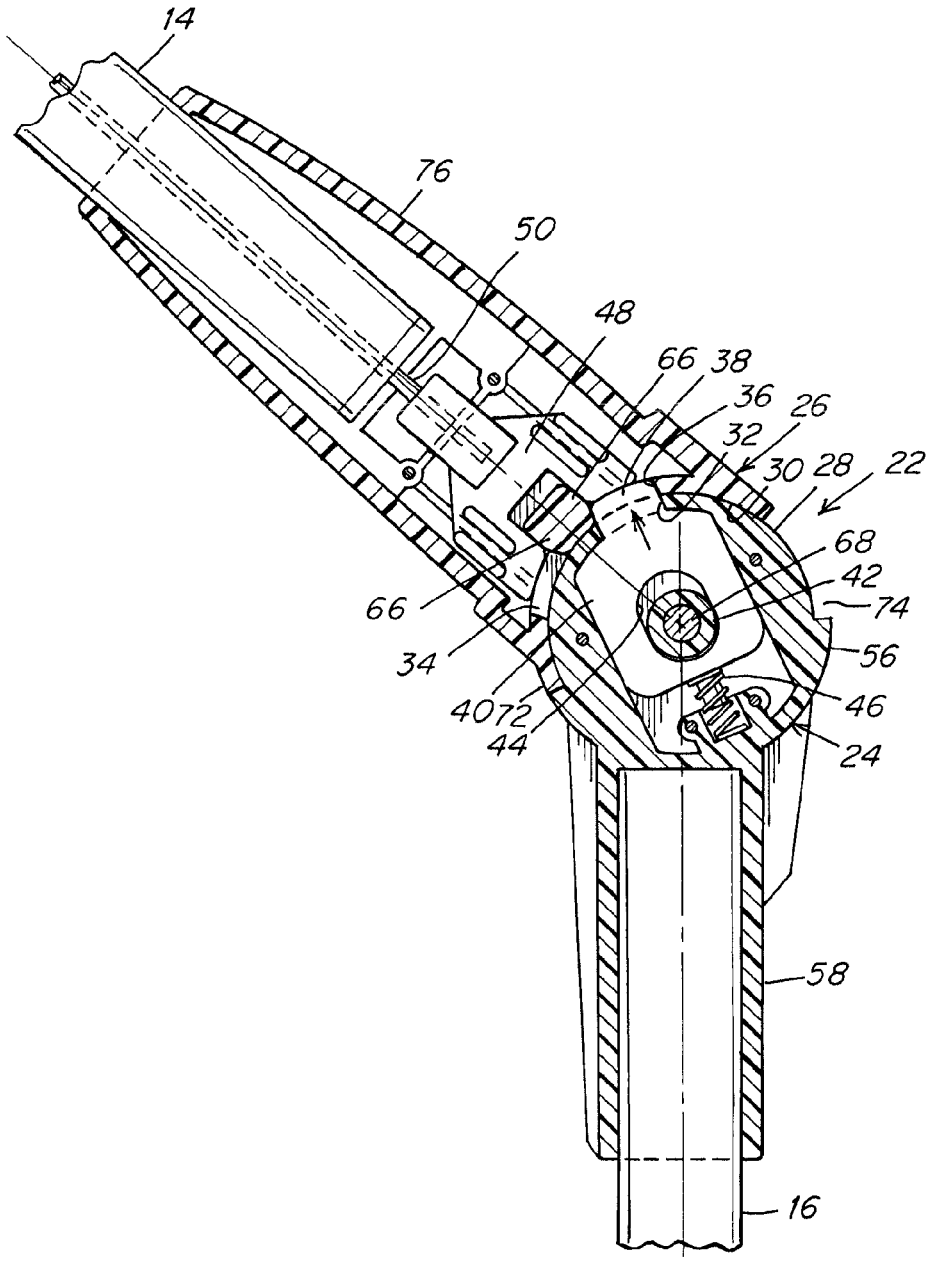
Figure 6:
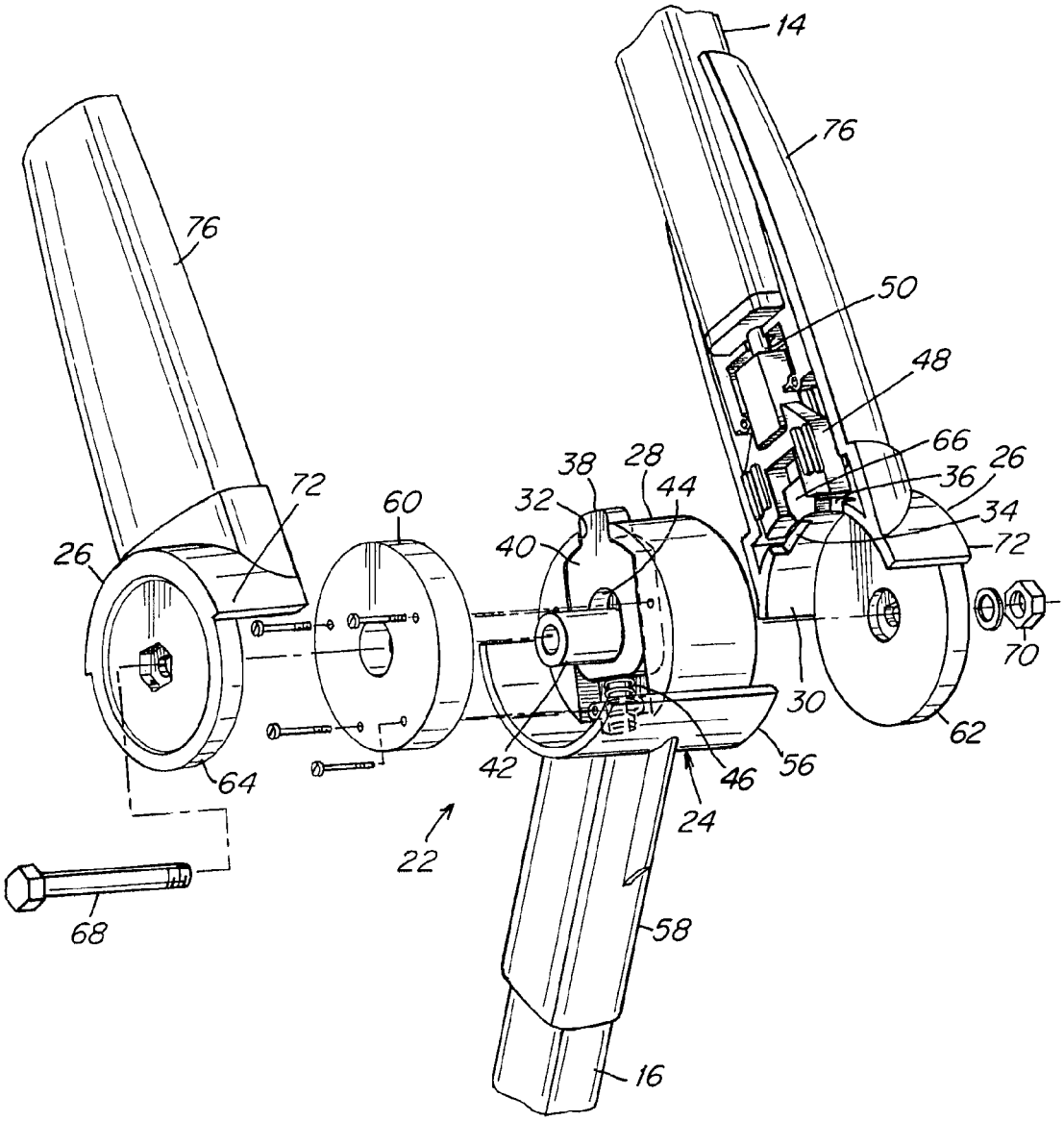
FIG. 6 is an exploded view of a joint according to the invention.

Various aspects of the invention are described below and/or shown in the drawings. These aspects of the invention may be used alone and/or in any suitable combination with each other. Aspects of the invention are not limited in any way by the illustrative embodiments shown and described herein.

Embodiments of the invention are directed to floor working devices, more particularly to floor cleaning devices, such as a steam mop, floor sweeper, floor buffer, or vacuum cleaner. Such floor cleaning devices typically include a pole that extends from a handle to a component housing that cooperates with a floor cleaning head (e.g., a housing that encloses a motor for a vacuum cleaner or a steam generator for a steam mop) or to a floor cleaning head itself. To help a user extend the cleaning head to low, hard-to-reach places, such as underneath furniture, the pole is divided into sections, for example a handle section and a component housing or cleaning head section, with these sections being selectively foldable from a first angled arrangement to a second angled arrangement. Representative is a substantially straight (approximately one hundred and eighty degrees—180°) first angled arrangement of the pole sections and a second folded arrangement where the pole sections are at a forty-five degree (45°) angle. The folded angled arrangement of the pole sections allows a user easily to position the cleaning head beneath a sofa or coffee table or other low slung object, for example, without having to change substantially the user's posture. The floor cleaning device may include one or more folded angle positions, and the first angled position need not be at a substantially straight orientation between adjacent pole sections. Further, the floor cleaning device may include adjustable angle positioning at two or more locations along a pole. For example, and without limitation, a cleaning device may include a pair of pole sections between a floor cleaning head and a component housing, and a second pair of pole sections between the component housing and a handle end of the pole. Each of the pair of pole sections may be adjustable amongst two or more different angular positions (including a straightened angle position), and the angular positions may vary as between the two different pairs of pole sections.

Particularly for floor cleaning equipment where the manipulation of the pole actuates or interfaces with an active functional operation, locking the pole sections when in a folded angle arrangement will enhance the transmission of force from the handle section of the pole to the operatively associated functional component. In a steam mop arrangement, for example, the pole may be operatively connected to a manual pump whereby pushing and/or pulling of the pole will actuate the pump. Manipulation of the pole to actuate or otherwise interface with an active component functionality in the floor cleaning head, component housing, or elsewhere in the floor cleaning device, is not limited to pushing and/or pulling, and also contemplates pivoting of the pole, rotation of the pole, and other movements of the pole. As will be appreciated by one of skill in the art, the pole may be directly or indirectly coupled to the active functional component.

An arrangement for locking pole sections of a floor cleaning device 10 at various angular orientations is shown in FIGS. 1-6. The pole 12 may be connected directly to a floor cleaning head 18, or indirectly such as by a pole extending from a component housing 20 which, in turn, is connected to the floor cleaning head. A joint 22 is provided between respective sections 14, 16 of the pole and includes first and second joint sections 24, 26 each having a curved sidewall 28, 30, the curved sidewalls being positioned closely adjacent each other and arranged for relative rotational movement. The first curved sidewall 28 (also referred to as the inner curved sidewall) includes an opening 32 that is registrable with either of first and second openings 34, 36 in the second curved sidewall 30 (also referred to as the outer curved sidewall) upon angular adjustment of the first and second joint sections. The first and second openings in the second curved sidewall correspond to the first and second angular positions of the joint. For example, the second opening may be located at a 45° angular adjustment from the first opening, with the first opening corresponding to a substantially straight relationship between the respective pole sections while the second opening correlates to an angle of approximately one hundred and thirty five degrees (135°) between the pole sections. Further locking openings may be provided in the second curved sidewall to provide additional angular positions of the joint/relative angular orientations of the pole sections. A locking tip 38 of a biased locking element 40 extends through the opening 32 in the first curved sidewall and will project through a locking opening 34, 36 in the second curved sidewall upon registration, locking the first and second curved sidewalls to one another and preventing further angular adjustment of the two joint sections. With the joint so locked, the pole sections are fixed in a predetermined angular orientation.

A pivot 42, which may be in the shape of a rod as shown, may extend between the first joint section to the second joint section, thereby facilitating relative rotation therebetween. The pivot may be centrally located as shown, or may be eccentrically positioned depending upon the desired rotational movement of the joint sections. A slot 44 in the locking element receives the pivot so that the locking element is slidable about the pivot. A spring 46 may be located between the locking element and an aspect of the first section, biasing the locking element towards the pivot and the opening in the first sidewall. As illustrated, the locking element may include a boss or other structure to support one end of the spring, and rails may be provided in the first joint section to contain the other end of the spring.

On the other side of the second curved sidewall, that is, the side that is not nested adjacent the first curved sidewall, is located a disengagement member 48 which may be selectively advanced by a user to force the locking tip out of the registered opening in the second curved sidewall. With the locking tip retracted, the curved sidewalls are unlocked and one or both curved sidewalls are again free to rotate. The disengagement member may have a U-shape, as shown, with each end of the legs of the "U" corresponding to a respective opening in the outer curved sidewall. Further legs may be added to the disengagement member where additional locking openings have been included in the second curved sidewall. The ends of the disengagement member may be angled, as shown, to provide a surface that conforms with the contour of the outer curved sidewall, facilitating rotation of the retracted locking tip. The overall shape of the disengagement member and of the ends that contact the locking tip may take other forms as should be apparent to one of skill in the art. Alternative arrangements of the disengagement member are contemplated, including a single disengagement bar that is moveable about the second curved sidewall to align in opposite position with the locking tip.

A linkage 50, such as an elongated rod as shown or other arrangement as should be apparent to one of skill in the art, may extend from a handle portion 52 of the cleaning device to the disengagement member. The linkage may be located within the pole section or external of the pole section. Movement of the linkage in the direction of the joint, such as by depressing a button 54 in the handle that is operatively associated with the linkage, will cause the disengagement member to press against the locking tip, forcing the locking tip back out of the locking opening in the second curved sidewall. The button may be biased away from the handle to draw the linkage away from the joint and, in turn, to move the ends of the disengagement member slightly away from the second curved sidewall. Other arrangements for controlling the disengagement member, and where a linkage is employed other arrangements for reciprocating the linkage, are contemplated as one of skill in the art will appreciate.

Although described specifically with respect to two angular positions, the joint may include three or more angular positions if desired. Further, the different angular positions of the joint are not limited to 0° and 45°; any angular positions of the joint are within the scope of the invention. As an example, then, a joint may be lockable at 0°, 45° and 90° (corresponding to angular orientations of the pole sections of 180°, 135° and 90°). The joint may have an overall cylindrical shape, although other shapes and configurations are suitable as should be apparent to one of skill in the art. As shown, the first joint section may be barrel-shaped and received within a yoke-shaped second joint section. The first section includes a curved housing wall 56 that may depend past the first curved sidewall and run the full length of the joint. A first pole section connector 58 may extend away from the curved housing wall to be joined, permanently or releasably, with a pole section, such as a pole section that connects to the component housing or to a floor cleaning head. The first pole section connector may be integrally formed with the curved housing wall. An endwall face may extend between the first curved sidewall and the curved housing wall. On the opposite side of the endwall face is a mount for the locking element, including opposed walls that provide support to the locking element. As mentioned earlier, the pivot is received through a slot in the body of the locking element. The pivot acts to confine the length of biased extension of the locking element. The portion of the first curved sidewall defining the locking opening and the opposed supporting walls impart rotational movement to the locking element when the first joint section is rotated. A disc 60 is opposite the end wall face and provides a surface, which may be smooth, along which the locking element will reciprocatingly move into and out of locking position.

The second joint section includes a pair of opposed cap faces 62, 64, and the second curved sidewall. An outer portion of the second curved sidewall, between the two locking openings, may include an expanded dimension 66, such as the rectangular shape shown, that bridges the legs of the disengagement member helping to stabilize and guide movement of this part. One of the cap faces may include a reduced circumferential shoulder to fit within the well defined in part by the endwall of the first joint section, helping to secure the joint together when the first joint section is inserted into the second joint section. Aligned openings may run through each cap face, the end face, the pivot member, and the disc, for receipt of a bolt 68 which may be fastened with a nut 70 at one of the cap faces to further secure together the components of the joint. The exterior of the second curved sidewall may form the housing sidewall 72 for the second section of the joint. The housing sidewalls of the first and second sections cooperate to form the housing for the joint. The two housing sidewall sections do not extend completely around the joint, there being a gap 74 between the ends that correlates to the angular adjustment of the joint. The ends of the respective housing sidewall sections may be arranged to abut one another when the joint is in either of its farthest-most angular extents.

A pole section connector 76 may extend from the curved sidewall of the second section to be joined, permanently or releasably, with a pole section, such as a pole section that extends to the handle. The second pole section connector may be configured to support and guide the disengagement member and may further support the linkage or a shaft housing including the linkage as shown. In certain embodiments, each leg of the disengagement member may include a pair of spaced rails that accept, respectively, a guide rail extending from the connector. The connector may be integral with the second joint section and may be formed in half pieces to facilitate assembly.

Although shown as substantially straight, either or both of the pole sections may be non-linear. The relative lengths of the pole sections may vary depending upon the application. The pole sections may be solid or hollow, and may be configured to support various components of the cleaning device such as a linkage, power wires, etc. Further, the pole sections and joint may be configured to provide a pathway for liquids, solids, and/or gas (such as air), or any combinations of the foregoing. The latter embodiment contemplates, for example, a joint and pole sections extending between a floor cleaning head (e.g., steam mop or vacuum nozzle) and a component housing (e.g., steam generator or suction motor and dust cup). The pole sections may be formed from metal, plastic, a combination of metal and plastic, and other materials as should be apparent to one of skill in the art. Similarly, the joint may be formed of plastic, metal, a combination of plastic and metal or other materials A representative floor cleaning device, in this case a steam mop, including the inventive joint is shown in FIG. 1. The steam mop includes a floor cleaning head having a steam outlet that opens in the direction of the floor, and may have a steam permeable fabric that is in the form of a pad or towel that is positioned at the floor cleaning side of the head or is in the form of a pocket that fits over the head. The cleaning head is positioned beneath a component housing, and preferably is pivotable in one or more directions relative to the housing. The component housing includes a reservoir 80 for water, a steam generator 82 for converting the water to steam, and a manual pump 84 (e.g., bellows or piston pump) for delivering water from the reservoir to the steam generator. A conduit runs from the steam generator to the steam outlet in the cleaning head. Wiring and a plug for connecting to a power source extends from the housing although, alternatively, a battery or other power source might be employed.

A pole extends from the component housing to a handle. One end of the pole is coupled to the manual pump in the housing, such that pushing and pulling of the pole actuates the pump. A rotatable joint, lockable in at least two different angular positions (such as 0°) and (45°, divides the pole into two sections—a first section extending from the component housing to the joint and a second section extending from the joint to the handle. The rotatable joint is as described earlier.

The operation of a floor cleaning device including a joint according to an embodiment of the invention will now be described. We start with the joint locked in a first angular position where the pole sections are in a substantially straight line (shown in phantom in FIG. 1). This arrangement is suitable for moving the cleaning head along an unobstructed floor surface. When the user wants the cleaning head to reach low spaces under furniture or a bed, the pole sections may be folded. A button on the handle is pressed, acting on a linkage that governs a disengagement member to unlock the joint. The user then applies a downward force to the handle causing the unlocked joint to rotate to the folded angular position, and in turn moving the pole sections to the folded position. The joint automatically locks in the "folded" angular orientation. Where the cleaning device includes an active functional component that is actuated by movement of the pole, the user can push the handle toward the component housing or cleaning head and the pushing force will be effectively transmitted along the folded pole to actuate the component functionality. To return to a straightened pole orientation, the user simply depresses the button again which releases the joint and allows the pole sections to be pivoted back to the extended configuration. Again, the joint will automatically lock when the straightened angular position is reached.

Although embodiments have been described in connection with floor cleaning devices such as a steam mop, floor sweeper, floor buffer, and vacuum cleaner, other floor and surface cleaning or working devices also are contemplated including, without limitation, a mop, a duster, a broom, and a shovel.

The above and other aspects of the invention will be appreciated from the detailed description and claims. It should be understood that although aspects of the invention have been described with reference to illustrative embodiments, aspects of the invention are not limited to the embodiments described. Also, aspects of the invention may be used alone, or in any suitable combination with other aspects of the invention.

What is claimed is:

1. A floor cleaning device, comprising:

a floor cleaning head;

a component housing including at least one active functional component;

a pole connectable to said component housing to actuate or interface with said at least one active functional component, said pole including two sections;

a joint for moving said two pole sections between two different angular orientations, said joint adapted to lock automatically in each of said two different angular orientations; and an actuator controllable at a handle portion of said pole to allow a user to selectively unlock said joint and move said two pole sections between said two different angular orientations;

wherein said joint includes an inner curved sidewall, an adjacent outer curved sidewall, said outer curved sidewall including first and second locking openings corresponding to said two different angular positions of said joint;

wherein said joint includes a pivot and a biased locking element reciprocatingly slidable about said pivot into and out of respective of said first and second locking openings;

the floor cleaning device further comprising a disengagement member for moving said biased locking element out of either of said first and second locking openings to unlock said joint; and wherein said disengagement member includes first and second legs corresponding to the first and second locking openings, respectively.

2. The floor cleaning device of claim 1, wherein said at least one functional component is a pump.

3. The floor cleaning device of claim 1, wherein said component housing includes a water reservoir, a steam generator, and a pump for delivering water from said reservoir to said generator.

4. The floor cleaning device of claim 1, wherein said two different angular orientations of said two pole sections includes a substantially straight angular orientation and a folded angular orientation.

5. The floor cleaning device of claim 1, wherein said actuator includes a linkage that extends between a user control at said handle portion of said pole and said disengagement member.

6. The floor cleaning device of claim 1, wherein said joint includes a locking system that is internal to said joint.

7. The floor cleaning device of claim 1, wherein said locking element is located on one side of said pair of curved walls and said disengagement member is located on the other side of said pair of curved walls.

* * * * *